US011187025B2

(12) United States Patent
Bars

(10) Patent No.: US 11,187,025 B2
(45) Date of Patent: Nov. 30, 2021

(54) METHOD FOR OPERATING A SYSTEM OF A MOTOR VEHICLE

(71) Applicant: Brose Fahrzeugteile GmbH & Co. Kommanditgesellschaft, Bamberg, Bamberg (DE)

(72) Inventor: Sebastian Bars, Bamberg (DE)

(73) Assignee: Brose Fahrzeugteile GmbH & Co. Kommanditgesellschaft, Bamberg, Bamberg (DE)

( * ) Notice: Subject to any disclaimer, the term of this patent is extended or adjusted under 35 U.S.C. 154(b) by 162 days.

(21) Appl. No.: 15/998,397

(22) Filed: Aug. 15, 2018

(65) Prior Publication Data

US 2019/0055770 A1 Feb. 21, 2019

(30) Foreign Application Priority Data

Aug. 15, 2017 (DE) ..... 10 2017 214 201.4

(51) Int. Cl.
*E06B 3/00* (2006.01)
*E05F 15/71* (2015.01)
(Continued)

(52) U.S. Cl.
CPC ..... *E05F 15/71* (2015.01); *E05F 15/616* (2015.01); *E05F 15/659* (2015.01);
(Continued)

(58) Field of Classification Search
CPC . E05F 15/71; E05F 15/79; E05F 15/70; E05F 15/72; E05F 15/662; E05F 15/659;
(Continued)

(56) References Cited

U.S. PATENT DOCUMENTS 9,308,802 B2 4/2016 Warburton et al.
9,580,046 B2 2/2017 Luu et al.
(Continued)

FOREIGN PATENT DOCUMENTS

DE 10222029 B3 2/2004
DE 202005017204 U1 3/2007
(Continued)

OTHER PUBLICATIONS

Japanese Office Action for Japanese Application No. 2018-148223 dated Jun. 28, 2019—English translation.

*Primary Examiner* — Jerry E Redman
(74) *Attorney, Agent, or Firm* — Muncy, Geissler, Olds & Lowe, P.C.

(57) ABSTRACT

A method for operating a system of a motor vehicle including a first electromotive door adjusting device having a first door, and a second electromotive door adjusting device having a second door. A request for carrying out a closing movement of the first door and for carrying out a closing movement of the second door is detected, and a priority rule is ascertained for activating the first electromotive door adjusting device and the second electromotive door adjusting device. The first electromotive door adjusting device and the second electromotive door adjusting device are activated on the basis of the priority rule. A system for a motor vehicle is also provided.

17 Claims, 2 Drawing Sheets

(51) Int. Cl.

| | |
|---|---|
| ***E05F 15/70*** | (2015.01) |
| ***E05F 15/79*** | (2015.01) |
| ***E05F 15/616*** | (2015.01) |
| ***E05F 15/659*** | (2015.01) |
| ***E05F 15/662*** | (2015.01) |
| ***E05F 15/72*** | (2015.01) |
| *E05F 15/77* | (2015.01) |

(52) U.S. Cl.
CPC ..... *E05F 15/662* (2015.01); *E05F 15/70* (2015.01); *E05F 15/72* (2015.01); *E05F 15/79* (2015.01); *E05F 15/77* (2015.01); *E05Y 2201/434* (2013.01); *E05Y 2400/36* (2013.01); *E05Y 2400/42* (2013.01); *E05Y 2900/531* (2013.01)

(58) Field of Classification Search
CPC ..... E05F 15/616; E05F 15/77; E05F 15/73; E05Y 2400/36; E05Y 2400/42; E05Y 2900/531; E05Y 2201/434
USPC ..... 49/506, 26–28
See application file for complete search history.

(56) References Cited

U.S. PATENT DOCUMENTS

| | | | | |
|---|---|---|---|---|
| 9,676,258 | B2 | 6/2017 | Warburton et al. | |
| 2009/0235588 | A1* | 9/2009 | Patterson | G01V 3/088 49/26 |
| 2009/0322504 | A1* | 12/2009 | Gifford | E05F 15/46 340/438 |
| 2011/0258931 | A1* | 10/2011 | Gao | E06B 9/80 49/28 |
| 2011/0265381 | A1* | 11/2011 | Guarnizo | H02H 7/0851 49/26 |
| 2017/0247932 | A1 | 8/2017 | Partsch et al. | |
| 2017/0321468 | A1 | 11/2017 | Frapsauce | |
| 2018/0236972 | A1* | 8/2018 | Linden | B60R 25/01 |

FOREIGN PATENT DOCUMENTS

| | | | |
|---|---|---|---|
| DE | 20 2015 106 608 | U1 | 4/2016 |
| DE | 10 2014 118 318 | A1 | 6/2016 |
| GB | 2505732 | A | 3/2014 |
| JP | 2002-121963 | A | 4/2002 |
| JP | 2002-364243 | A | 12/2002 |
| JP | 2006225953 | A | 8/2006 |
| JP | 2009-241857 | A | 10/2009 |
| JP | 2015-533960 | A | 11/2015 |
| JP | 2018-115508 | A | 7/2016 |

* cited by examiner

METHOD FOR OPERATING A SYSTEM OF A MOTOR VEHICLE

This nonprovisional application claims priority under 35 U.S.C. § 119(a) to German Patent Application No. 10 2017 214 201.4, which was filed in Germany on Aug. 15, 2017 and which is herein incorporated by reference.

BACKGROUND OF THE INVENTION

Field of the Invention

The present invention relates to a method for operating a system of a motor vehicle, comprising a first electromotive door adjusting device having a first door and comprising a second electromotive door adjusting device having a second door. The invention furthermore relates to a system of a motor vehicle.

Description of the Background Art

Motor vehicles have electromotive door adjusting devices for increasing comfort. When activated, a door, such as a rear hatch or a side door, is swiveled with the aid of an electric motor. The electric motor is operatively connected to the door with the aid of a worm drive or the like, so that the door is either opened or closed depending on the rotational movement of the electric motor. The electric motor of the electromotive door adjusting device is usually activated with the aid of a switch, which is disposed on the door, for example within a handle of the door. After activating the particular electromotive door adjusting device, the electric motor is usually essentially immediately energized, so that it is essentially clearly apparent to the user that the command to activate the electric motor was correctly detected. The electric motor itself is usually provided with a brushless or brush-type design and is regulated to a certain rotational speed with the aid of a controller, so that the door is moved at a predetermined speed. For example, an essentially constant speed is specified, which increases a quality impression for the user of the motor vehicle.

If the motor vehicle was exposed to sunlight, for example for a comparatively long period of time, and if it is in a comparatively warm environment, it is possible that an interior of the motor vehicle is heated to a comparatively high level. It is thus possible that the temperature in the interior of the motor vehicle exceeds 50° C. To remedy the situation, all or at least a large share of the doors are usually opened by a user of the motor vehicle, so that the warm air of the interior may escape from the motor vehicle. Even if a comparatively extensive loading activity is carried out, all or at least a large share of the doors of the motor vehicle are usually opened, which facilitates loading. In both cases, it is necessary to close the doors again before the trip begins. For this purpose, it is necessary for the driver of the motor vehicle to move to each door and to operate the particular switch to activate the electric motor for swiveling the particular door into the closed state.

SUMMARY OF THE INVENTION

It is therefore an object of the present invention to provide a particularly suitable method for operating a system of a motor vehicle as well as a particularly suitable system of a motor vehicle, a load on a vehicle electrical system being advantageously reduced and, in particular, a comfort being increased.

The method can be used to operate a system of a motor vehicle, which can b e, for example, a passenger car. The system comprises a first electromotive door adjusting device having a first door. The electric motor of the electromotive door adjusting system is operatively connected to the first door. In particular a gearset, such as a worm gear, is driven with the aid of the electric motor, which is operatively connected to the first door with the aid of additional components of the electromotive door adjusting device, for example with the aid of a spindle or with the aid of a cable pull. The first door itself preferably has a receiving point for a fitting or the fitting itself, with the aid of which the door is coupled to a body of the motor vehicle. For example, the fitting is a hinge, so that the first door is swiveled with respect to the vehicle body. The first door is, in particular, a side door or a trunk lid. Alternatively, the fitting is a slide bar, so that the first door is designed in the manner of a sliding door. The adjustment path of the first door is thus either essentially straight or curved.

The first door can be moved in one or two adjustment directions, depending on the rotational direction of the electric motor of the first electromotive door adjusting device, so that the first door is placed from an at least partially closed position into an at least partially open position, and an opening movement is thus carried out. In the other rotational direction of the electric motor, the first door is placed from the at least partially open position into an at least partially closed position, and a closing movement is thus carried out. The electric motor is provided, for example, with a brushless design and is electrically contacted with an electrical system of the motor vehicle with the aid of a converter. The converter is part of a control unit, with the aid of which the rotational speed and rotational direction of the electric motor is set.

The system also comprises a second electromotive door adjusting device, which includes a second door. The second door is driven with the aid of an electric motor of the second electromotive door adjusting device, in particular via a gearset, such as a worm gear, which is operatively connected to the second door and the electric motor of the second electromotive door adjusting device. The second door advantageously includes a fitting or a receiving point for a fitting for connection to the body of the motor vehicle, for example a hinge or a slide bar, so that the second door my be swiveled or pushed with respect to the body. The electric motor of the second electromotive door adjusting device is preferably of the same design as the electric motor of the first electromotive door adjusting device. In particular, the second electromotive door adjusting device has the same design as the first electromotive door adjusting device, or has an at least similar design thereto. For example, the second electromotive door adjusting device is mirror-symmetrical with respect to the first electromotive door adjusting device. The first electromotive door adjusting device is suitably assigned to one side of the motor vehicle, and the second electromotive door adjusting device is assigned to the second side of the motor vehicle. Alternatively, one of the two electromotive door adjusting devices is assigned to a second or third seat row of the motor vehicle, and the remaining electromotive door adjusting device is assigned to a first seat row. In another alternative, the door of one of the two electromotive door adjusting devices is the trunk lid, while the door of the other electromotive door adjusting device is a side door, which is, for example swivelably or slidably coupled to the body of the motor vehicle.

The first and/or second electromotive adjusting device(s) can be a closing mechanism, with the aid of which the particular door may be placed into a locked or at least latched state. An additional force is applied to the door, in particular by selecting another gear stage or with the aid of another electric motor, so that a counterforce applied with a possible seal may be overcome.

The system advantageously comprises additional electromotive door adjusting devices, which have, for example the same design as the first or second electromotive door adjusting device or are at least symmetrical with respect to one of the two electromotive door adjusting devices. The system suitably comprises a total of four or five electromotive door adjusting devices, the motor vehicle advantageously having a total of four side doors, each of which is driven with the aid of one electric motor of the particular assigned electromotive door adjusting device. In particular, the driver's door and the front-seat passenger door are driven with the aid of the electric motor. Two possible rear doors are also each suitably part of one of the electromotive door adjusting devices, the rear doors being, for example, swiveled or pushed with the aid of the particular assigned electric motor. The system preferably comprises the fifth electromotive door adjusting device, whose door is suitably the trunk lid of the motor vehicle.

The method provides that, in a first work step, a request to carry out a closing movement of the first door and to carry out a closing movement of the second door is detected. The request thus includes a command to place the first door into the closed position. The request also includes a command to place the second door into the closed position. If the system comprises additional electromotive door adjusting devices, the request also includes, for example, the commands to carry out a closing movement using these electromotive door adjusting devices. The first door and the second door are to be placed in a closed position with the aid of the closing movement, so that they are each essentially flush with the body of the motor vehicle. For example, the first and/or the second door is/are to be locked.

The request can be generated, for example, with the aid of a switch in an interior of the motor vehicle. Alternatively, for example, a switch is connected to a vehicle body or to one of the two doors. In another alternative, a wireless key or another portable unit includes a switch. For example, the request is generated by actuating the switch in a certain pattern, in particular by actuating it for a certain period of time, for example 3 seconds or 5 seconds. Alternatively, the switch is provided and configured explicitly only to generate the request. In particular, the request is a so-called "central closure," in which all doors of the motor vehicle are to be placed in a closed position.

In a second work step, a priority rule is ascertained. The priority rule is used to activate the first electromotive door adjusting device and to activate the second electromotive door adjusting device. For example, the priority rule is stored in a memory of the system or is generated/created based on additional parameters or settings. With the aid of the priority rule, for example a speed and/or a speed profile is determined, on the basis of which the closing movement of the first and the second electromotive door adjusting devices is to be carried out. The priority rule is, for example, always the same and/or matched to the motor vehicle. Alternatively, the priority rule is ascertained on the basis of present requirements. In another work step, the first electromotive door adjusting device and the second electromotive door adjusting device are activated on the basis of the priority rule. For this purpose, a certain parameter data set is transmitted to a control unit of the particular electromotive door adjusting device. Alternatively, the electric motors of the two electromotive door adjusting devices are operated with the aid of a shared control unit, based on the priority rule. A regulation of the electric motors to a particular speed, which is predefined with the aid of the priority rule, advantageously takes place. If the system comprises additional electromotive door adjusting devices, the priority rule is also preferably used to activate the additional electromotive door adjusting devices, and they are suitably also activated on the basis of the priority rule.

Based on the request, both doors can be moved into the closed position, which increases comfort. This also makes it possible to respond to present requests with the aid of the priority rule, which further increases comfort. Keeping a load on the electrical system of the motor vehicle comparatively low is also facilitated with the aid of the priority rule, provided that this is specified with the aid of the priority rule. As a result, a load on the vehicle electrical system is reduced, and providing it with a less robust design is made possible. In particular, a capacity of a battery is reduced hereby and/or a conductor cross section of possible cables is reduced, which decreases the weight of the motor vehicle.

An end of the closing movement of the first electromotive door adjusting device is preferably time-shifted with respect to an end of the closing movement of the second electromotive door adjusting device, based on the priority rule. In other words, based on the priority rule, the closing movement of the first electromotive door adjusting device is ended at a different point in time than the closing movement of the second electromotive door adjusting device. The first door of the first electromotive door adjusting device is advantageously already in the closed position when the second door is still being adjusted. An energizing of the first electromotive door adjusting device is suitably ended while an energizing of the second electromotive door adjusting device is still being maintained. If the system comprises additional electromotive door adjusting devices, all endings of the particular closing movements are preferably time-shifted with respect to each other, based on the priority rule, so that the doors are each placed into the particular closed position, a time-shifted with respect to each other.

For example, the electric motors of the two electromotive door adjusting devices are activated at a different speed based on the priority rule, at least in time segments and/or in sections. The electric motors are suitably operated at the same speed if the adjustment travel of one of the doors up to the particular close position is greater than the adjustment travel of the door of the remaining electromotive door adjusting device, which improves an optical impression for a user of the motor vehicle.

Due to the time shift of the time-shifted end of the two closing movements, a maximum power consumption of the two electromotive door adjusting devices is limited if the particular door is moved against a stop and/or against a block to ensure a secure closing of the particular door. If the electric motor is blocked due to a stop, against which the door is placed into the closed position, the power consumption is comparatively high, which is why in this case a comparatively high electric current occurs, and thus a comparatively high load on the electrical system of the motor vehicle. Due to the time shift, the load on the vehicle electrical system produced with the aid of the two electromotive door adjusting device occurs in a time-shifted manner, so that a maximum load is reduced, which would otherwise result, for example, in damage to possible cables of the vehicle electrical system and/or the tripping of a circuit-breaker/fuse. Due to the time-shifted ending, an increase in the air pressure in an interior of the motor vehicle is also avoided, which could otherwise result in an impairment of the comfort of a person situated inside the motor vehicle. A noise development is also reduced.

For example, the closing movement of the first electromotive door adjusting device is started, time-shifted with respect to the closing movement of the second electromotive door adjusting device. For example, the first electromotive door adjusting device is activated first, and the first door thus adjusted. Only when the first door has already been moved for a certain period of time, in particular 1 second, 2 seconds, 3, seconds, 5 seconds or 10 seconds, the electric motor of the second electromotive door adjusting device is activated and the second door thus adjusted. The second door is suitably already adjusted while the first door is still being adjusted. Alternatively, the second door is only adjusted after the first door has been placed into the closed position. In other words, the adjustment of the first door is ended first, and the adjustment of the second door is carried out subsequent thereto, which results in a further reduced load on the electrical system of the motor vehicle.

For example, the first door is first placed, in particular traversed, into a first position, and the second door is placed, in particular traversed, into a second position, based on the priority rule. The first position is preferably located at a comparative short distance from the closed position, for example between 1 cm and 10 cm and, for example, essentially equal to 5 cm. In other words, only a further movement of the first door by 5 cm is necessary to place the first door from the first position into the closed position. The second position is preferably situated at a comparatively short distance from the assigned closed position, for example between 1 cm and 10 cm, in particular essentially equal to 5 cm. In other words, only a further movement of the second door by 5 cm is necessary to place the second door into the closed position. The first position is suitably situated at the same distance from the assigned closed position as the second position is situated from the assigned closed position. For example, the particular door rests loosely against a body of the motor vehicle in the first and/or second position(s), and the ability of a closing mechanism of the particular electromotive door adjusting device to grip the particular door in the first or second position is made possible.

The first door and the second door can be simultaneously or substantially simultaneously placed into the first position or into the second position. In other words, the electric motors of the particular electromotive door adjusting device are activated, and thus energized, simultaneously or substantially simultaneously, for which reason the two doors are moved to the first or second position at the same time. The first door is placed, in particular traversed, from the first position into the closed position. The second door is also placed, in particular traversed, from the second position into the closed position. The placement of the first or second door into the particular closed position takes place in a time-shifted manner. For example, the second door remains held in the second position until the first door is in the closed position and/or an energizing of the electric motor of the first electromotive door adjusting device is ended. The second door is placed from the second position into the closed position only subsequently thereto. The second door is thus held stationary in the second position for a certain period of time.

As a result, a comparatively rapid placement of the doors is ensured, on the one hand, so that they are situated only a comparatively short distance from the vehicle body, namely in the first or second position. On the other hand, a load on the vehicle electrical system is reduced due to the time-shifted placement into the particular closed position. An increased air pressure in the interior of the motor vehicle, due to the closing of the particular door, is also avoided, since any air present may escape, for example through a slit, which is formed between the closed position and the first/second position. The second position is also situated at a comparatively short distance from the vehicle body, so that only a comparatively slight increase in the air pressure, due to the placement of the second door into the closed position, only briefly occurs.

If the system comprises additional electromotive door adjusting devices, the doors of the particular additional electromotive door adjusting devices are placed into an assigned position, which is situated at a distance from the particular closed position, preferably by less than 15 cm, in particular between 2 cm and 10 cm. These doors are placed into the first or second position at the same time as the placement of the first and second doors. The placements into the particular closed positions take place time-shifted with respect to each other.

The first electromotive door adjusting device and the second electromotive door adjusting device can be activated in such a way that the first door reaches the first position at the same point in time that the second door reaches the second position. For example, the adjustment speed of the two electromotive door adjusting devices is adapted. The adjustment speed of one of the two electromotive door adjusting devices is suitably at least temporarily increased. Alternatively or combined therewith, for example, the closing movement of the first electromotive door adjusting device is started, time-shifted with respect to the closing movement of the second electromotive door adjusting device. In other words, the energizing of the electric motor of one of the two electromotive door adjusting devices in begun earlier. Due to the simultaneous or substantially simultaneously reaching of the first or second position, and optical impression and a quality impression are increased for a user of the motor vehicle. If additional electromotive door adjusting devices are present, they are advantageously also activated in such a way that the doors of the additional electromotive door adjusting devices reach their particular positions at the same time as the first and second doors.

In particular, the priority rule is ascertained on the basis of a potential source of danger. In other words, a potential source of danger is ascertained first, and the priority rule is ascertained, for example generated, on the basis thereof. For example, an approaching motor vehicle, an approaching bicyclists or an approaching passer-by is detected. The electromotive door adjusting device situated closed to the source of danger is suitably actuated first with the aid of the priority rule, so that the door of this electromotive door adjusting device is removed from the danger zone or does not represent a danger. For example, if the first electromotive door adjusting device is thus located on a side of the motor vehicle on which the bicyclist is approaching, and the second electromotive door adjusting device is located on the opposite side of the motor vehicle, the first electromotive door adjusting device is actuated first, and the first door is placed into the closed position. The bicyclist may therefore pass the motor vehicle essentially unhindered. As a result, a danger potential of the motor vehicle as well as a likelihood of damage to the motor vehicle are reduced.

Alternatively or combined therewith, the priority rule is ascertained for this purpose on the basis of a present ambient condition. For example, a parking place of the motor vehicle is used as an ambient condition. For example, the electromotive door adjusting device which is situated on a road side is used first, i.e. on a side of the motor vehicle facing a traffic lane. Only afterwards is the door preferably placed into the closed position, which is located on the side of the motor vehicle opposite thereto, or, for example, the rear hatch, if the electromotive door adjusting device has the rear hatch as the door. Alternatively, a prevailing wind or the like is used, for example, as the present ambient condition, and the electromotive door adjusting device situated on the side facing the wind is actuated first, so that a penetration of wind masses into the interior of the motor vehicle is prevented.

Alternatively or particularly preferably combined therewith, the priority rule is ascertained on the basis of a position of the first electromotive door adjusting device with respect to a position of the second electromotive door adjusting device. The one of the two particular electromotive door adjusting devices which is situated at the rear in the direction of travel is preferably actuated first. The door located farther to the rear, i.e. the door with the aid of which, for example, access to a second or third seat row is facilitated, is therefore placed into the closed position first. Only afterwards is the electromotive door adjusting device actuated and its door placed into the closed state, which facilitates the access to a first seat row of the motor vehicle, i.e. to a driver's seat and a front-seat passenger seat. An exit of children or other passengers from the motor vehicle, for example, is avoided in this manner.

For example, the door of the electromotive door adjusting device which is assigned to a front-seat passenger side of the motor vehicle, is placed in the closed position first. Only afterwards is the door of the electromotive door adjusting device assigned to the driver's seat placed into the closed position. This thus makes it possible for the driver of the motor vehicle to leave the motor vehicle even after a comparatively long period of time, in particular if, for example, one of the passengers of the motor vehicle has additional needs or a problem. If the method is canceled by the driver, at least one of the doors is already in the closed position. The trunk lid is suitably placed into the closed position comparatively late, for example as the last door, based on the priority rule. Alternatively, the trunk lid is placed into the closed position as the first door of all electromotive door adjusting devices, so that a removal of objects from the trunk by an unauthorized person is prevented.

The priority rule is preferably ascertained based on an adjustment path of the first door and an adjustment path of the second door. If the adjustment path is essentially straight, and the door is thus a sliding door, the latter is advantageously placed into the closed position first. For example, the door whose adjustment path runs along a circular movement, i.e. is swiveled to reach the closed position, is activated only subsequently thereto.

For example, the priority rule is suitably ascertained on the basis of the generation site of the request. The generation site of the request is thus determined first. In particular, whether the request was generated inside the motor vehicle or outside the motor vehicle is ascertained first. If the generation site is located inside the motor vehicle, i.e. if a user of the motor vehicle preferably actuates a switch inside the motor vehicle, the electromotive door adjusting devices situated at the rear in the direction of travel are suitably actuated first, and their particular doors are preferably placed into the assigned closed positions first. As a result, an exit of any people in the rear seats, such as children, is prevented, the driver, for example, still being able to get out to assist the people seated in back. The driver's door is suitably placed into the closed position last.

If the generation site is located outside the motor vehicle, the door on the side of the motor vehicle facing away from the generation site is, in particular, placed into the closed position first or adjusted first. The doors on the side of the motor vehicle facing the generation site are suitably placed into the closed position only subsequently thereto. The user ensures that no possible obstacle or the like is located on the side of the motor vehicle facing away from the generation site upon generating the request. However, it may be relatively difficult to monitor whether an obstacle, for example, is present at that location. A monitoring of this type is, however, possible on the side of the motor vehicle facing the generation site. As a result, a security is increased on the basis of the priority rule.

For example, the priority rule is ascertained on the basis of a unit, with the aid of which the request is generated, such as suitably a handle, a switch, a (wireless) remote control or a gesture and/or voice control system. An end of the method and/or a cancellation of the method, in particular in the case of an error, is/are preferably signaled to a user, for example acoustically, visually or haptically.

The system is part of a motor vehicle and comprises a first electromotive door adjusting device having a first door. The system also comprises a second electromotive door adjusting device having a second door. The two electromotive door adjusting devices are, for example, of the same design or at least similar to each other, in particular form mirror images of each other. The system furthermore comprises a control unit, which is preferably coupled via signals to the two electromotive door adjusting devices. The control unit is operated according to a method, in which a request to carry out a closing movement of the first door and to carry out a closing movement of the second door is first detected. A priority rule for activating the first electromotive door adjusting device and for activating the second electromotive door adjusting device is also ascertained. The first electromotive door adjusting device and the second electromotive door adjusting device are activated on the basis of the priority rule. The control unit is preferably suitable, in particular provided and configured, to carry out the method. The system is advantageously used to carry out the method. For example, each of the electromotive door adjusting devices includes a controller, and the priority rule, or at least part of the priority rule, is transmitted to the particular controller with the aid of the control unit. Alternatively, the electric motors of the two electromotive door adjusting devices are activated with the aid of the control unit. The control unit suitably includes a memory, in which the priority rule is stored.

The refinements and advantages discussed in connection with the method for operating a system of a motor vehicle are to be similarly transferred to the system of a motor vehicle and vice versa.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
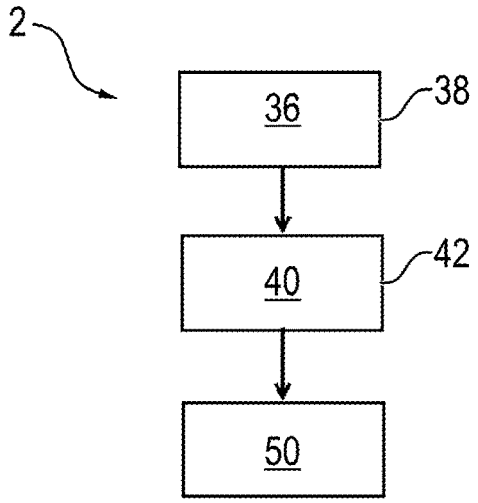
FIG. 1 shows a method for operating a system of a motor vehicle.
Figure 2:
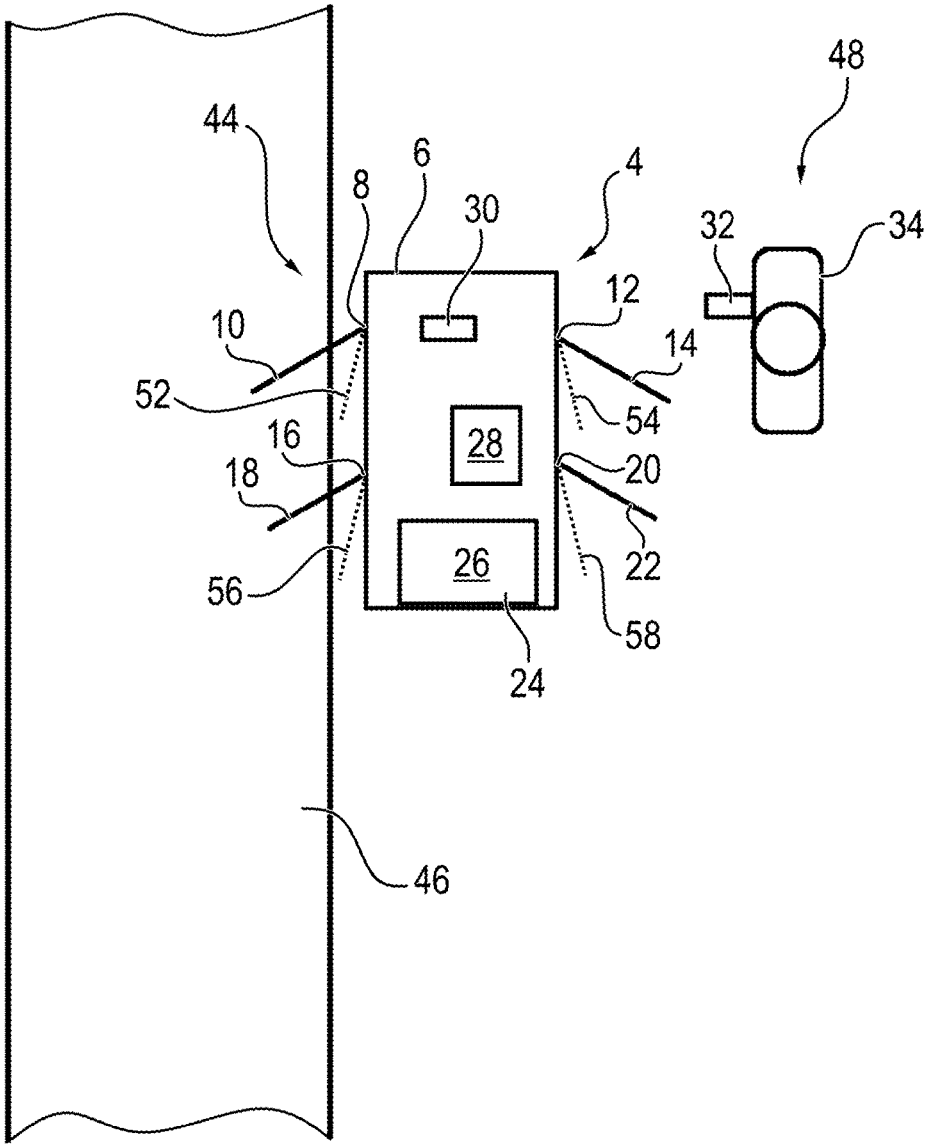
FIGS. 2, 3 each schematically show a top view of the motor vehicle, including the system.

FIG. 1 shows a method for operating a system 4 of a motor vehicle 6 illustrated in a top view in FIG. 2. System 4 comprises a first electromotive door adjusting device 8, which includes a first door 10 driven with the aid of an electric motor. System 4 also comprises a second electromotive door adjusting device 12, which includes a second door 14 driven with the aid of an electric motor. First door 10 is a driver's door, and second door 14 is a front-seat passenger's door. System 4 also comprises a third electromotive door adjusting device 16, which includes a third door 18 driven by an electric motor, as well as a fourth electromotive door adjusting device 20, which includes a fourth door 22 driven by an electric motor. Third door 18 and fourth door 22 are assigned to a second seat room of motor vehicle 6, so that an access to this seat row is facilitated thereby. Third door 18 is situated on the driver's side and fourth door 22 is situated on the front-seat passenger's side, i.e. on the side of second door 14. First electromotive door adjusting device 8 forms a mirror image of second electromotive door adjusting device 12, and third electromotive door adjusting device 16 forms a mirror image of fourth electromotive door adjusting device 20. System 4 also comprises a fifth electromotive door adjusting device 24, which includes a fifth door 26 in the form of a rear hatch, which is driven by an electric motor. The electric motors of electromotive door adjusting devices 8, 12, 16, 20, 24 are brushless and of an identical design.

System 4 furthermore comprises a control unit 28 and an input device 30. Input device 30 is a switch, which is integrated into a center console. Control unit 28 is coupled electrically and via signals to input device 30 and to electromotive door adjusting devices 8, 12, 16, 20, 24. The electric motors of electromotive door adjusting devices 8, 12, 16, 20, 24 are also energized with the aid of control unit 28. A rotational speed and a rotational direction of the particular electric motors are specified with the aid of control unit 28. System 4 also comprises a wireless controller 32, which is integrated into a key of motor vehicle 6. When wireless controller 32 or control unit 28 is actuated by a user 34, an activation of electromotive door adjusting devices 8, 12, 16, 20, 24 takes place.

The method, which is carried out with the aid of control unit 28, provides that, in a first work step 36, a request 38 is detected to carry out a closing movement of first door 10 and second door 14 as well as third door 18 and fourth door 22 and fifth door 26. Request 28 is generated by user 34 with the aid of input device 30 or wireless controller 32 and corresponds, for example, to the function "central closure." A check is first made of whether doors 10, 14, 18, 22, 26 are in an open position, which is illustrated in FIG. 2. If one of doors 10, 14, 18, 22, 26 is already in a closed position, request 38 is modified in such a way that the command for the closing movement of this door 10, 14, 18, 22, 26 is removed.

In a subsequent second work step 40, a priority rule 42 is ascertained for activating first electromotive door adjusting device 8, second electromotive adjusting device 12, third electromotive adjusting device 16, fourth electromotive adjusting device 20 and fifth electromotive adjusting device 24. Priority rule 42 is called up from a memory of control unit 28 or a new one is ascertained. A present ambient condition 44 is first ascertained, for which purpose the location of a traffic lane 46 with respect to motor vehicle 6 is first determined. In the example, this traffic lane is located on the side of first door 10 and third door 18. A generation site 48 of request 38 is also determined. In the example, request 38 was generated with the aid of wireless controller 32, which user 34 is holding in his hand. User 34 is located next to front-seat passenger door 14.

Priority rule 42 is ascertained on the basis of present ambient condition 44 and the generation site of request 38. Priority rule 42 contains the instruction that the doors on the side of traffic lane 46, namely first door 10 and third door 18, are to be placed into the closed position first. Of these doors, third door 18 is to be closed first, since it is located the farthest away from generation site 46. Fourth door 22 and then second door 14 are to be closed subsequently thereto, since these doors are on the side of motor vehicle 6 facing away from traffic lane 46; of these doors, the two doors situated the farthest away from generation site 46 are to be closed first. Fifth door 26 is to be closed last, since it is not a side door but a rear hatch.

In a subsequent third work step 50, first, second, third, fourth and fifth electromotive door adjusting devices 8, 12, 16, 20, 24 are activated on the basis of priority rule 42. First, second, third and fourth electromotive door adjusting devices 8, 12, 16, 20 are first activated simultaneously or substantially simultaneously, and first door 10 is swiveled into a first position 52, second door 14 is swiveled into a second position 54, third door 18 is swiveled into a third position 56 and fourth door 22 is swiveled into a fourth position 58. In first position 52, first door 10 only loosely rests against the vehicle body. In second position 54, second door 14 also rests loosely against the body of motor vehicle 6 and in third position 56, third door 18 only loosely rests thereagainst. In fourth position 58, fourth door 22 loosely rests against the body of the motor vehicle. Electromotive door adjusting devices 8, 12, 16, 20 are activated in such a way that first door 10 reaches first position 52 at the same time that second door 14 reaches second position 54. Third door 18 also reaches third position 56 and fourth door 22 reaches fourth position 58 at the same point in time. For this purpose, the driving speed of the electric motors and the start of energizing are suitably adapted.

Once each of doors 10, 14, 18, 22 has reached assigned position 52, 54, 56, 58 in each case, the particular electric motor is stopped. Third door 18 is subsequently placed into the closed position. Once this has taken place, first door 10 is placed into the closed position. Fourth door 22 is subsequently placed into the closed position. Once fourth door 22 is in the closed position, second door 14 is also placed into the closed position. In other words, first, second, third and fourth doors 10, 12, 18, 22 are placed into the particular closed position, time shifted from first, second, third and fourth positions 52, 54, 56, 58. A closing aid of particular electromotive door adjusting device 8, 12, 16, 20 is used for the placement into the closed position, and particular door 10, 14, 18, 22 continues to be swiveled to the vehicle body until a movement is prevented due to a stop on the vehicle body. A power consumption of the particular electric motor is comparatively high. Due to the time shift, a maximum load on the vehicle electrical system providing the necessary electric energy is reduced, for which reason cost-effective cables and a cost-effective battery may be used. Due to the time-shifted closing of doors 10, 14, 18, 22, a buildup of a comparatively high air pressure within motor vehicle 6 is also avoided.

Once second door 14 is in the closed position, fifth electromotive door adjusting device 24 and fifth door 26 are also swiveled into the closed position. For example, the swiveling takes place continuously. In other words, the adjustment of rear hatch 26 is not interrupted. In summary, the end of the closing movement of first electromotive door adjusting device 8 is time-shifted with respect to an end of the closing movement of second electromotive door adjusting device 12 on the basis of priority rule 42. The ends of the closing movements of additional electromotive door adjusting devices 16, 20, 24 are also each time-shifted with respect to each other. The closing movement of fifth electromotive door adjusting device 24 is also started, time-shifted with respect to the closing movement of first, second, third and fourth electromotive door adjusting devices 8, 12, 16, 20.

Figure 3:
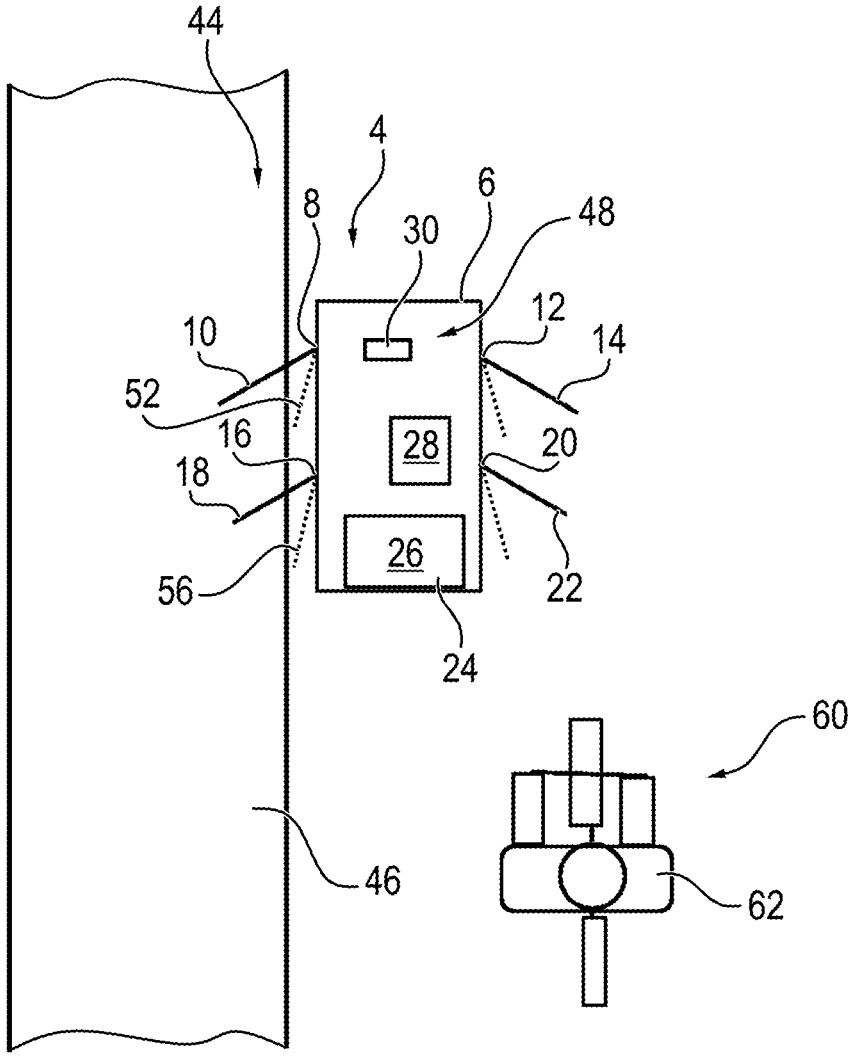

Another situation for ascertaining priority rule 42 is shown in FIG. 3, present ambient conditions 44 being identical. Traffic lane 46 is again located on the side of first and third doors 10, 18. However, a potential source of danger 60 is additionally present in the form of a bicyclist 62, who approaches from the rear of motor vehicle 6 and whose path runs it past motor vehicle 6 on the side of second and fourth doors 14, 22. input device 30 is actuated by user 34 to close doors 10, 14, 18, 22, 26, so that generation site 48 is located inside motor vehicle 6.

Based on present ambient condition 44, potential source of danger 60 and generation site 48, priority rule 42 is ascertained again, and electromotive door adjusting devices 8, 12, 16, 20, 24 are activated accordingly. Fourth door 22 and second door 14 are placed into the closed position first, the closing movement of second electromotive door adjusting device 12 being started shortly after the beginning of the adjusting movement of fourth door 22. Fourth and second doors 22, 14 are essentially immediately swiveled into the closed position, and an adjustment is not interrupted in second or fourth position 54, 58. As a result, second and fourth doors 14, 22 are moved out of the path of bicyclist 62, so that an injury to bicyclist 62 and a damage to motor vehicle 6 are avoided.

Third door 18 is subsequently swiveled to third position 56, and first door 10 is simultaneously or substantially simultaneously swiveled to first position 52. Third door 18 is then swiveled into the closed state first, and first door 10 is swiveled into the closed position subsequently thereto. Fifth door 26, in turn, is swiveled into the closed position last. The closing movement of first electromotive door adjusting device 8 is thus started, time-shifted with respect to the closing movement of second electromotive door adjusting device 12.

Figure 4:
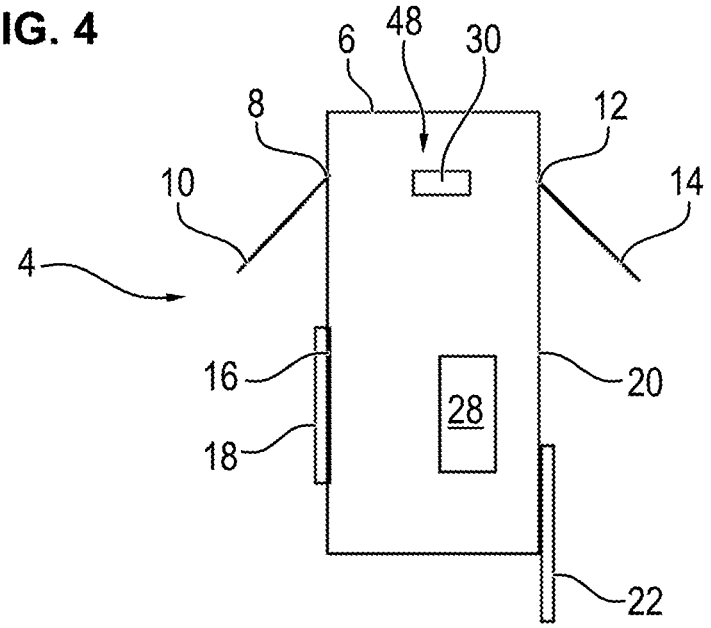
FIG. 4 shows a top view of an embodiment of the motor vehicle.

A modification of motor vehicle 6 is illustrated in FIG. 4, third and fourth doors 18, 22 each being designed as sliding doors, so that they have a linear adjustment path. The adjustment path of first and second doors 10, 14, however, is in the shape of a circle arc. In other words, first and second doors 10, 14 are swiveled for the purpose of opening and closing, while third and fourth doors 18, 22 are pushed for the purpose of opening and closing. The actuation, in turn, takes place with the aid of input device 30, so that generation site 48 of request 38 is located inside motor vehicle 6. Since the adjustment path of third and fourth electromotive door adjusting devices 16, 20 is essentially straight, and since generation site 48 is inside motor vehicle 6, third and fourth electromotive door generating devices 16, 20 are to be actuated first, since children are usually in the back seat of motor vehicle 6.

As a result, priority rule 42 is ascertained in such a way that third door 18, which may potentially be on the side of traffic lane 46, is closed first, and fourth door 22 is closed subsequently thereto. Afterwards, the front-seat passenger side is to be closed and second door 14 thus placed into the closed position. Only afterwards is first door 10 to be placed into the closed position, so that a driver of motor vehicle 6 may still get out, for example, and assist other people. Method 2 would also be canceled at this point, a relatively large number of doors 10, 14, 18, 22, 26 nevertheless remaining in the closed position. In summary, priority rule 42 is also ascertained with respect to the position of second electromotive door adjusting device 12 on the basis of the position of first automotive door adjusting device 8, namely in such a way that the driver's side is the last to be closed.

In summary, the door movements are adapted, depending on the movements of the other doors 10, 14, 18, 22, 26. Electromotive door adjusting devices 8, 12, 16, 20, 24 are preferably activated consecutively over time, in particular slightly delayed. Alternatively or combined therewith, doors 10, 14, 28, 22, 26 are traversed in such a way that they are almost in the closed position. Doors 10, 14, 18, 22, 26 are stopped there and each placed into the closed position one after the other. Additionally or alternatively, a matching of the movements of individual doors 10, 14, 18, 22, 26 takes place, in particular the speed and/or position thereof, to permit a uniform transversing of all doors 10, 14, 18, 22, 26.

On this basis, a load on the battery of motor vehicle 6 during the closing and actuation of the particular closing aid is relieved. Comparatively pronounced peaks in the electrical current are also avoided, which are caused, for example, by the fact that all closing aids and/or electric motors are operated at the same time. Due to a time-shifted activation of individual electromotive door adjusting devices 8, 12, 16, 20, 24, all doors 10, 14, 18, 22, 26 are closed within a relatively short period of time, current peaks caused by activating the assigned closing aid in each case being avoided. During a transversing of individual doors 10, 14, 18, 22, 26 into the almost closed position and the subsequent closing of individual doors 10, 14, 18, 22, 26 one after the other, current peaks caused by activating the closing aid are avoided. Matching the movements of individual doors 10, 14, 18, 22, 26 improves an optical impression for user 34.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for operating a system of a motor vehicle, the motor vehicle comprising a first door having a first electromotive door adjusting device and a second door having a second electromotive door adjusting device, the method comprising:

detecting a request for carrying out a closing movement of the first door and for carrying out a closing movement of the second door;

determining a priority between activating the first electromotive door adjusting device and activating the second electromotive door adjusting device to carry out the request; and activating the first electromotive door adjusting device to actuate the closing movement of the first door and activating the second electromotive door adjusting device to actuate the closing movement of the second door, the priority being instructions that control the closing movement of the first door and control the closing movement of the second door, wherein an end of the closing movement of the first electromotive door adjusting device is time-shifted with respect to an end of the closing movement of the second electromotive door adjusting device based on the priority.

2. The method according to claim 1, wherein a beginning of the closing movement of the first electromotive door adjusting device is time-shifted with respect to a beginning of the closing movement of the second electromotive door adjusting device based on the priority.

3. The method according to claim 2, wherein the closing movement of the first electromotive door adjusting device is started, time-shifted with respect to the closing movement of the second electromotive door adjusting device.

4. The method according to claim 2, wherein the first door is placed into a first position and the second door is substantially simultaneously placed into a second position, and wherein the first door is placed from the first position into a closed position and the second door is placed from the second position into the closed position.

5. The method according to claim 4, wherein the first electromotive door adjusting devices and the second electromotive door adjusting device are activated such that the first door reaches the first position at a same time that the second door reaches the second position.

6. The method according to claim 1, wherein the priority is determined based on a detected source of danger to the closing movement of the first door or the second door.

7. The method according to claim 1, wherein the priority is determined based on a present ambient condition.

8. The method according to claim 1, wherein the priority is determined based on a position of the first electromotive door adjusting device with respect to a position of the second electromotive door adjusting device.

9. The method according to claim 1, wherein the priority is determined based on an adjustment path of the first door and an adjustment path of the second door.

10. The method according to claim 1, wherein the priority is determined based on a generation site of the request.

11. A door system for the motor vehicle comprising:

the first electromotive door adjusting device associated with the first door;

the second electromotive door adjusting device associated with the second door; and a control unit that is operated according to the method according to claim 1.

12. The method according to claim 1, wherein actuating the first door moves the first door into a closed position over a first time period, wherein actuating the second door moves the second door into a closed position over a second time period, and wherein the first time period and the second time period are not a same time period.

13. The method according to claim 1, wherein the determined priority specifies different priorities for actuation of detected requests, wherein a first priority is assigned to a first request generated outside of the motor vehicle, wherein a second priority is assigned to a second request generated inside of the motor vehicle, the first priority not being equal to the second priority.

14. The method according to claim 1, wherein the priority modifies the request based on a danger to the closing movement of the first door or the second door detected outside the vehicle.

15. The method according to claim 1, wherein actuation of the first door moves the door about one end of the first door towards the motor vehicle, wherein actuation of the first door moves the door about one end of the second door towards the motor vehicle.

16. A system for operating doors of a motor vehicle, comprising:

a first electromotive door adjusting device adapted to control a first door of the motor vehicle;

a second electromotive door adjusting device adapted to control a second door of the motor vehicle; and a control unit having memory on which at least one priority is stored as an instruction, the control device receiving a first request to actuate a first door, the control unit receiving a second request to actuate a second door, the control unit signaling the first electromotive door adjusting device to move the first door from a first position to a second position, the control unit signaling the second electromotive door adjusting device to move the second door from a third position to a fourth position, wherein the control unit signals the first electromotive door adjusting device and the second electromotive door adjusting device according to the priority, the priority determining an order of carrying out the first request and the second request, wherein the first door reaches the second position before the second door reaches the fourth position in accordance with the priority, and wherein the second position is a closed position of the first door and the fourth position is a closed position of the second door.

17. A method for operating a system of a motor vehicle, with a first electromotive door adjuster for a first door, and with a second electromotive door adjuster having a second door, and with further electromotive door adjusters, comprising:

detecting a request for performing a closing movement of the first door and for performing a closing movement of the second door;

determining a priority for controlling the first electromotive door adjuster and the second electromotive door adjuster based on current requirements; and controlling the first electromotive door adjuster and the second electromotive door adjuster and the other electromotive door adjusters based on the priority, the priority being instructions that control the closing movement of the first door and control the closing movement of the second door, wherein the determined priority specifies different priorities for actuation of detected requests, wherein a first priority is assigned to a first request generated outside of the motor vehicle, wherein a second priority is assigned to a second request generated inside of the motor vehicle, the first priority not being equal to the second priority.

* * * * *